US008851714B2

(12) United States Patent
Gielen et al.

(10) Patent No.: US 8,851,714 B2
(45) Date of Patent: Oct. 7, 2014

(54) COOLING ARRANGEMENT FOR A LUMINAIRE

(75) Inventors: Vincent S. D. Gielen, Eindhoven (NL); Arjan De Winter, Geldrop (NL); Theodoor C. Treueniet, Best (NL); Renatus W. C. Van Der Veeken, Eindhoven (NL); Johannes A. Rebergen, Eindhoven (NL); Godfried C. G. M. Manders, Susteren (NL)

(73) Assignee: Koninklijke Philips N.V., Eindhoven (NL)

( * ) Notice: Subject to any disclaimer, the term of this patent is extended or adjusted under 35 U.S.C. 154(b) by 603 days.

(21) Appl. No.: 13/139,543

(22) PCT Filed: Nov. 18, 2009

(86) PCT No.: PCT/IB2009/055146

§ 371 (c)(1),
(2), (4) Date: Jun. 14, 2011

(87) PCT Pub. No.: WO2010/070484

PCT Pub. Date: Jun. 24, 2010

(65) Prior Publication Data

US 2011/0242829 A1 Oct. 6, 2011

(30) Foreign Application Priority Data

Dec. 15, 2008 (EP) ..... 08171641

(51) Int. Cl.
*H01T 19/00* (2006.01)
*H01T 13/50* (2006.01)

(52) U.S. Cl.
CPC ..... *H01T 19/00* (2013.01); *H01T 13/50* (2013.01)
USPC ..... 362/373; 362/294; 362/218; 362/264

(58) Field of Classification Search
CPC ..... H01T 19/00; H01T 13/50
USPC ..... 362/373, 294, 218, 217.07, 264, 362/296.07; 62/78
See application file for complete search history.

(56) References Cited

U.S. PATENT DOCUMENTS 3,638,058 A 1/1972 Fritzius
3,665,241 A * 5/1972 Spindt et al. ..... 313/351
(Continued)

FOREIGN PATENT DOCUMENTS

WO 9205875 A1 4/1992
WO 9412282 A1 6/1994
WO 2006079111 A2 7/2006

OTHER PUBLICATIONS

Garimella, "Advances in Mesoscale Thermal Management Technologies for Microelectronics", 2006, pp. 1165-1185, Journal 37, Purdue Libraries.

*Primary Examiner* — Sharon Payne
(74) *Attorney, Agent, or Firm* — Meenakshy Chakravorty

(57) ABSTRACT

A cooling arrangement comprising a source electrode, a first and a second target electrode arranged at a distance from the source electrode and control circuitry for controlling a voltage being applied between the source electrode and at least one of the first and the second target electrodes. The voltage is controlled such that an airflow resulting from a potential difference between the source electrode and at least one of the first and the second target electrodes is arranged to have alternating directions. By means of the invention it may be possible to provide cooling of a device having similar or better performances than a conventional heat sink and fan system, but with a smaller size and weight as well as being silent.

15 Claims, 3 Drawing Sheets

(56) References Cited

U.S. PATENT DOCUMENTS

| | | | | |
|---|---|---|---|---|
| 4,424,549 | A * | 1/1984 | Ensing | 361/230 |
| 4,658,338 | A * | 4/1987 | Bertozzi | 362/640 |
| 7,806,565 | B2 * | 10/2010 | Lu et al. | 362/296.07 |
| 7,821,765 | B2 * | 10/2010 | Kinsey | 361/231 |
| 2004/0007000 | A1 * | 1/2004 | Takeda et al. | 62/78 |
| 2006/0061967 | A1 | 3/2006 | Kim et al. | |
| 2007/0002534 | A1 | 1/2007 | Mongia et al. | |
| 2007/0277667 | A1 | 12/2007 | Dunn-Rankin et al. | |

* cited by examiner

COOLING ARRANGEMENT FOR A LUMINAIRE

TECHNICAL FIELD

The present invention relates to an arrangement for providing cooling of a device, specifically to a luminaire comprising such a cooling arrangement. The present invention also relates to a corresponding method.

BACKGROUND OF THE INVENTION

Recently, much progress has been made in increasing the brightness of light emitting diodes (LEDs). As a result, LEDs have become sufficiently bright and inexpensive to serve as a light source in for example illumination arrangements such as lamps with adjustable color. By mixing differently colored LEDs any number of colors can be generated, e.g. white. An adjustable color lighting system is typically constructed by using a number of primary colors, and in one example, the three primaries red, green and blue are used. The color of the generated light is determined by which of the LEDs that are used, as well as by the mixing ratios. To generate "white", all three LEDs have to be turned on.

In for example industrial and consumer products, high power LEDs are used for replacing traditional incandescent light bulbs in applications such as automotive, industrial, backlight display, and architectural detail lighting systems. However, the high power LEDs suffers from a high thermal load when used in traditional lighting applications. Important parameters of the LED such as efficiency, lifetime, and color are very sensitive to the temperature of the LED, thus making thermal management a key issue in LED lighting applications, especially in adjustable color lighting system where color control is essential for providing a useful application. Of course the same counts for white LEDs, such as for example different types of phosphor coated LEDs.

A popular way of conducting heat management, to reduce the thermal load, is to mount the LEDs on a printed circuit board (PCB), and equip the PCB with a heat sink or dedicate a portion of a metal layer of the PCB for such purpose. This type of cooling arrangement is often bulky since the heat sink needs to be quite large to provide the necessary cooling to the LED. By adding a fan blowing air at the heat sink a smaller heat sink can be used. However, the fan will consume extra power and will often add unwanted noise to the lighting arrangement.

Additionally, fans are subject to wear, limiting their lifetime and reliability. Furthermore, the large bulky structure hampers the design of elegant and sleek lighting applications. A more effective and sleeker cooling arrangement involving a cooling apparatus with an electrostatic flow modifier is presented in patent application US 2007/0002534. The flow modifier is provided for directing an airflow from a fan for providing increased heat transfer from a device surface onto which the flow modifier is arranged. However, not even the cooling arrangement of the cited patent application will solve the problem of getting rid of the bulky fan.

Hence, there is a need for an improvement in relation to the cooling of a device, and more specifically that overcome or at least alleviates the prior art problems of bulky cooling components.

SUMMARY OF THE INVENTION

According to an aspect of the invention, the above is met by a cooling arrangement, comprising a source electrode for generating air ions, a first and a second target electrode arranged at a distance from the source electrode, and control circuitry for controlling a voltage being applied between the source electrode and at least one of the first and the second target electrodes, wherein the application of the voltage is controlled such that an airflow resulting from a potential difference between the source electrode and at least one of the first and the second target electrodes is arranged to have alternating direction by alternately applying the voltage between the source electrode and the first target electrode and between the source electrode and the second target electrode, respectively.

The general concept of the present invention is based on the fact that it may be possible to transport air with the aid of so-called electrical ion-wind, using a cooling arrangement comprising a source electrode and at least a first and a second target electrode provided downstream of the source electrode. It should be noted that it may be possible, and within the scope of the invention, to use more than the first and the second target electrodes. Preferably, the electrodes are connected to respective terminals of a voltage source having such a voltage that an electron discharge, generating air ions, occurs at the source electrode. The electron discharge results in air ions having the same polarity as the source electrode and possible also charged so-called aerosols, i.e. solid particles or liquid drops present in the air, where the particles or drops that are being charged upon collision with the charged air ions. The air ions move rapidly, under influence of the electrical field, from the source electrode to the at least one first and second target electrodes, where they relinquish their electrical charge and become re-charged air molecules. During this movement the air ions permanently collide with the non-charged air molecules and thus the electrostatic forces are transferred to these latter air molecules, which are thus drawn in a direction from the source electrode towards the target electrode, thereby causing an air transport in the shape of the so-called ion-wind through the hollow structure.

By means of this aspect of the present invention it may be possible to provide cooling of a device, such as a luminaire, having similar or better performances than a conventional heat sink and fan system, but with a smaller size and weight as well as being able to operate silently. Due to the possibility of generating a concentrated airflow close to the heat source, e.g. light source of the luminaire, it may be possible to also reduce the need for heat sinks, fans, thermal pastes, etc. Preferably, the source electrode is a corona electrode. Accordingly, the electron discharge is a corona discharge generating air ions.

The distance between the source electrode and at least one of the first and the second target electrodes should be more than the distance at which electrical breakdown occurs. In an embodiment, the potential difference between the source electrode, e.g. the corona electrode, and at least one of the first and the second target electrodes is sufficient for ionization of molecules in the surrounding air at the corona electrode and subsequent air flow from said electrode towards the target electrode. Preferably, the cooling arrangement is driven in a low voltage operation, thereby increasing the possibility to provide a safe and reliable arrangement.

It is possible to in different ways arrange the source electrode and the first and the second target electrodes. In one embodiment the electrodes are arranged on a carrying member, without limitation for example represented by a hollow structure having a shell. In such a case the electrodes may be coated on the inside of hollow structure. For example, the source electrode and at least one of the first and the second target electrodes may be arranged on the inside of the shell of the hollow structure (e.g. as a coating on the inside of the shell). In another embodiment the source electrode and at least one of the first and the second target electrodes may instead (or also) be arranged onto a substrate (in this case representing the carrying member), for example fixated between a first and a second portion of the hollow structure. Preferably, the source electrode, the first and the second target electrodes and/or the inner surface of the shell may be coated with a noble metal, which will reduce and possibly break down ozone that may be produced at the source electrode.

In an embodiment, the hollow structure comprises an inflow portion and an outflow portion. Also, the hollow structure may be arranged such that it comprises at least one opening having a cone shaped air inlet towards the inside of the hollow structure for providing a Venturi effect. The Venturi effect in relation to the present invention will be further discussed below. Preferably, the opening is arranged in close connection with the device that needs cooling, such as for example a light source.

In an advantageous embodiment of the invention, the cooling arrangement is arranged together with a light source, thereby forming a luminaire. For achieving a high energy efficiency the light source is preferably selected from a group comprising light emitting diodes (LEDs), organic light emitting diodes (OLEDs), polymeric light emitting diodes (PLEDs), inorganic LEDs, cold cathode fluorescent lamps (CCFLs), hot cathode fluorescent lamps (HCFLs), plasma lamps. As mentioned above, LEDs have much higher energy efficiency in comparison to conventional light bulbs which generally deliver at best about 6% of their electric power used in the form of light. The skilled addressee would appreciate that it of course would be possible to use a standard incandescent light source, such as an argon, krypton, and/or xenon light source. In an even more preferred embodiment, the light source may comprise a plurality of differently colored LEDs for providing a luminaire with adjustable color, or alternatively a white LED, such as for example different types of phosphor coated LEDs (e.g. remote phosphor LEDs).

In a possible implementation of the luminaire, the side of cone shaped air inlet in the hollow structure facing towards the outside of the hollow structure may comprise a reflective member. Such a reflective member may be provided as a reflector for the light source of the luminaire, for example when the cone shaped opening is arranged in connection with the light source. It should be noted that a cone shaped opening comprising a reflective member may be provided with any of the above discussed embodiments of cooling arrangement of the invention.

According to another aspect of the invention, there is provided a method for cooling a luminaire, comprising providing a carrying member, arranging a source electrode for generating air ions on the carrying member, arranging a first and a second target electrode on the carrying member, wherein the first and the second target electrodes are arranged at a distance from the source electrode, controlling a voltage being applied between the source electrode and at least one of the first and the second target electrodes, wherein the voltage is controlled such that an airflow resulting from a potential difference between the source electrode and at least one of the first and the second target electrodes is arranged to have alternating direction by alternately applying the voltage between the source electrode and the first target electrode and between the source electrode and the second target electrode, respectively.

By means of this aspect of the present invention it is, in a similar and analogue way as described above with reference to the first aspect of the invention, possible to provide cooling of a device, such as a luminaire, having similar or better performances than a conventional heat sink and fan system, but with a smaller size and weight as well as being able to operate silently. Due to the possibility of generating a concentrated airflow close to the heat source, e.g. light source of the luminaire, it may be possible to also reduce the need for heat sinks, fans, thermal pastes, etc. Additionally, this aspect also provides for the possibility to use different types of carrying members, such as a hollow structure having a shell or a substrate such as for example a PCB. Other implementation specific solutions are of course possible.

Further features of, and advantages with, the present invention will become apparent when studying the appended claims and the following description. The skilled addressee realize that different features of the present invention may be combined to create embodiments other than those described in the following, without departing from the scope of the present invention.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1A:
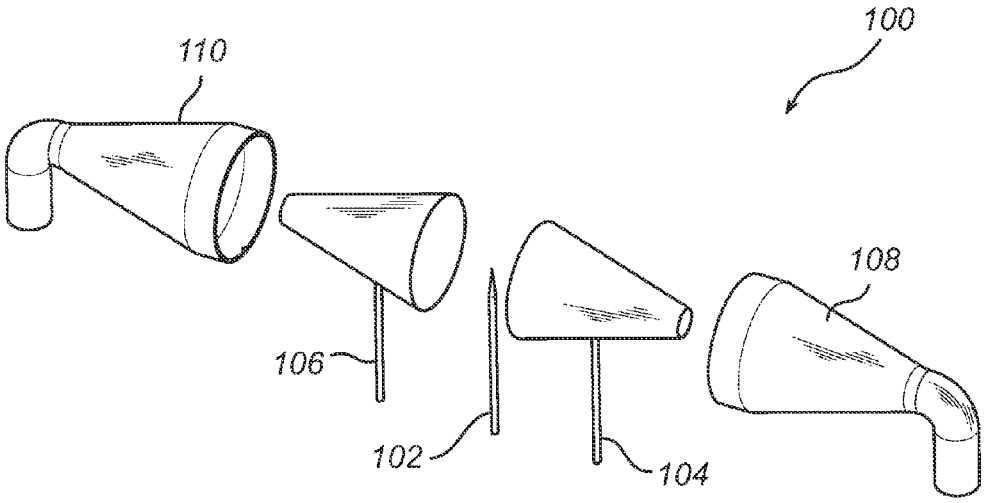
FIG. 1 is a schematic illustration of a conceptual cooling arrangement according to a currently preferred embodiment of the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled addressee. Like reference characters refer to like elements throughout.

Figure 1B:
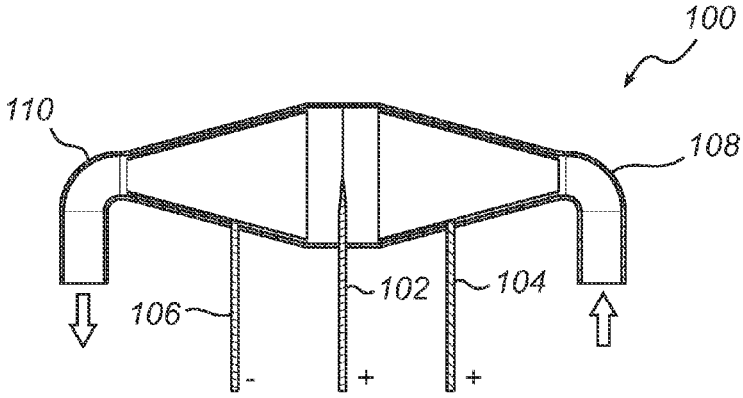

Referring now to the drawings and to FIG. 1 in particular, there is depicted a schematic illustration of a cooling arrangement according to a currently preferred embodiment of the present invention. FIG. 1*a* shows the separate part of the cooling arrangement 100, comprising a source electrode in the form of a corona electrode 102, a first target electrode 104 and a second target electrode 106. Additionally, the cooling arrangement 100 comprises a first and a second enclosure 108 and 110, respectively, adapted to fit over the corona electrode 102 and the target electrodes 104, 106 and to provide a shell for the cooling arrangement 100. The respective enclosures preferably comprise end portions formed for airflow intake and outtake. In FIG. 1*b*, the functionality of the cooling arrangement 100 is shown, indicating the direction of an airflow of the cooling arrangement 100 when a potential difference is applied between the corona electrode 102 and the target electrodes 104, 106. As an example, in FIG. 1*b* there is provided a potential difference between the corona electrode 102 and the target electrode 106, while the other target electrode 104 is kept at essentially the same voltage potential as the corona electrode 102. Accordingly, and as discussed above, the potential difference between the corona electrode 102 and the target electrode 106 should be kept as low as possible for among other things safety reasons. However, in one exemplary but non limiting embodiment the potential difference between the corona electrode 102 and the target electrode 106 the potential difference is at least 7 kV, and preferably more than 10 kV, possibly producing an airflow at around 1-3 m/s. In the same embodiment the distance between the corona 102 and target electrode 104 may be selected to be around approximately 7 mm.

Figure 1C:
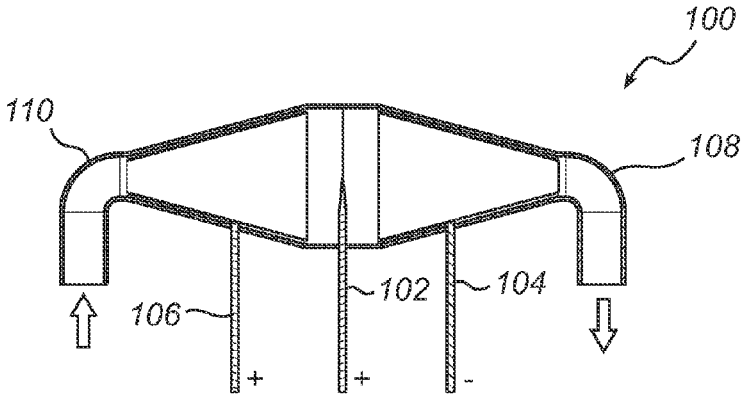

By providing the potential difference, an electron discharge will occur at the corona electrode 102 which in turn will generate air ions. That is, the electron discharge results in air ions having the same polarity as the corona electrode 102 and possible also charged so-called aerosols, i.e. solid particles or liquid drops present in the air, where the particles or drops being charged upon collision with the charged air ions. The air ions move rapidly, under influence of the electrical field, from the corona electrode 102 to the target electrode 106 where they relinquish their electrical charge and become recharged air molecules. During this movement the air ions permanently collide with the non-charged air molecules and thus the electrostatic forces are transferred to these latter air molecules, which are thus drawn in a direction from the source electrode towards the target electrode, thereby causing an airflow in the shape of an ion-wind through the enclosure 108, 110. At the endpoint of the enclosure 110 closest to the target electrode 106 there will be an outflow as indicated by an arrow, whereas there will be an inflow at the endpoint of the enclosure 108 closest to the other target electrode 108. In FIG. 1*c* the potential difference is changed, in this case such that the potential difference is applied between the corona electrode 102 and first target electrode 104, causing an airflow in the opposite direction of FIG. 1*b*. Similarly, the voltage potential at the second target electrode 106 may be kept at a level essentially the same as the level at the corona electrode 102. Additionally, for minimizing the possible generation of ozone, it may be suitable to cover, plate or manufacture the corona 102 and/or target electrodes 104, 106 with a noble metal, such as for example gold or silver.

Preferably, the operation illustrated in FIGS. 1*b* and 1*c* will possibly occur sequentially and a plurality of times, thus causing an alternating airflow which may be suitable for cooling for example a luminaire. For controlling such an alternating application of a potential difference between the corona electrode 102 and at least one of the first 104 and the second 106 target electrode, a control circuitry (not shown) may for example be used. The control circuitry may include a microprocessor, microcontroller, programmable digital signal processor or another programmable device. The control circuitry may also, or instead, include an application specific integrated circuit, a programmable gate array programmable array logic, a programmable logic device, or a digital signal processor. Where the control circuitry includes a programmable device such as the microprocessor or microcontroller mentioned above, the processor may further include computer executable code that controls operation of the programmable device. Additionally, the control circuitry may comprise an input for receiving a temperature indication from a sensor arranged in the vicinity of the object, such as an LED or the luminaire, which is intended to be cooled by means of the cooling arrangement 100, thereby providing additional control capabilities.

Figure 2:
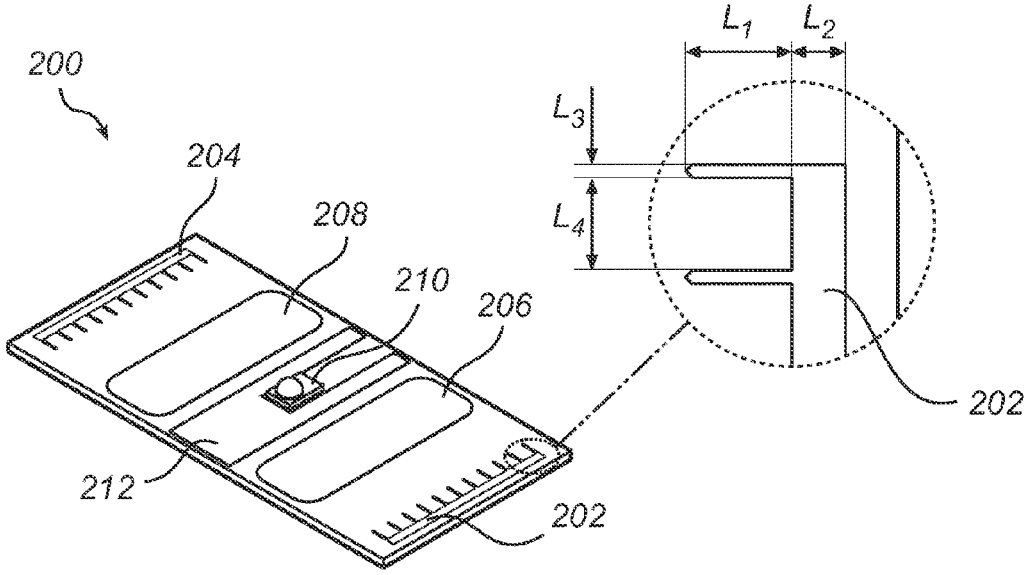
FIG. 2 is a schematic illustration of a cooling arrangement according to another currently preferred embodiment of the present invention.

Turning now to FIG. 2, in which it is illustrated a schematic illustration of a cooling arrangement 200 according to another currently preferred embodiment of the present invention. The cooling arrangement 200 is provided in conjunction with a substrate such as a printed circuit board (PCB) onto which a first corona electrode 202, a second corona electrode 204, a first target electrode 206 and a second target electrode 208 are arranged. Furthermore, on the PCB there is additionally provided a light source, such as a light emitting device (LED) 210. During operation of the LED 210, a heat spreader 212 is used for transporting the generated heat away from the LED 210 and spread it over a larger space.

A similar arrangement may also be provided on the opposite side of the PCB. Thereby ionization may effectively take place on both sides of the PCB. Ionization will only occur at the sharp, positively charged electrodes, or corona electrodes. Therefore air will only be displaced from one side of the LED to the other per half phase. The direction of the air movement changes the next half phase in the exemplary case of using a high voltage AC generator. Directional change of the airflow therefore equals the AC frequency.

Accordingly, during operation of the cooling arrangement 200, during a first phase a potential difference will be applied between the first corona electrode 202 and the first target electrode 206. The operation is similar to the operation described in conjunction to FIG. 1*b*. That is, an airflow will start to flow in a direction from the first corona electrode 202 towards the first target electrode 206. During a second phase, the potential difference will instead be applied between second corona electrode 204 and the second target electrode 208, thus causing an airflow in an essentially opposite direction. A detailed view of a section of the first corona electrode 202 is also provided in FIG. 2. The detailed view illustrates an exemplary implementation of the first corona electrode, including four length/width indications $L_1$-$L_4$ for the sizing of the corona electrode 202. In a non limiting embodiment the lengths $L_1$ and $L_2$ may be selected in the range from 1-5 mm, whereas the width $L_3$ of a corona electrode portion may be kept around approximately 0.25 mm, possibly having a distinctive triangular edge at the open end. Additionally, the distance between two different corona electrode portions may be selected from 1-3 mm. The skilled addressee however realizes that different length widths may be selected for example depending on the potential difference applied between a corona and a target electrode. The embodiment depicted above incorporates only one cooling arrangement 200, but it is understood that an array of such units can be constructed utilizing only one central high voltage generator.

Figure 3A:
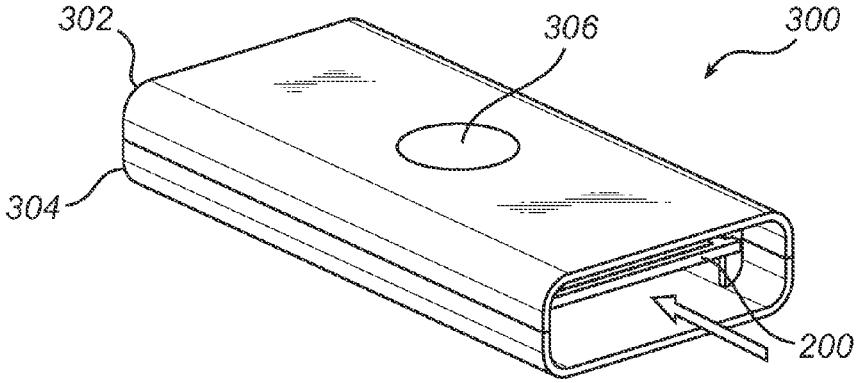
FIG. 3 is a schematic illustration of a luminaire comprising an exemplary cooling arrangement according to the invention.

FIG. 3 goes on to illustrate a schematic illustration of a luminaire 300 comprising an exemplary cooling arrangement 200 according to the invention. Initially, in FIG. 3*a* there is provided a conceptual perspective side view of a luminaire 300 inside of which the PCB based cooling arrangement 200 may be arranged. In comparison to the cooling arrangement 100 illustrated in FIG. 1, the cooling arrangement 300 of FIG. 3*a* also includes two enclosing portions 302 and 304, which has been adapted for fixing the PCB 200, for example by means of a snap fitting. Additionally, the luminaire 300 comprises a cone shaped opening 306 in at least one of the enclosing portions 302, 304. During operation of the cooling arrangement 200 inside of the luminaire 300, the opening 306 will act as a Venturi opening allowing for a Venturi effect to be realized. The Venturi effect is the fluid pressure, e.g. air pressure, which results when an incompressible fluid flows through a constricted section of pipe. Accordingly, the Venturi effect may be derived from a combination of Bernoulli's principle and the equation of continuity. That is, the velocity of the airflow must increase through the constriction to satisfy the equation of continuity, while its pressure must decrease due to conservation of energy: the gain in kinetic energy is supplied by a drop in pressure or a pressure gradient force. Thus, an airflow in a first direction will cause a pressure drop at both sides of the PCB, causing air to be sucked in through the opening 306, and possibly at an additional opening on the opposite side of the luminaire 300. This is similar to jet impingement, with the difference being that the airflow through the opening is caused by a pressured drop at the outlet of the opening, rather than a pressure increase at the inlet of the opening.

Figure 3B:
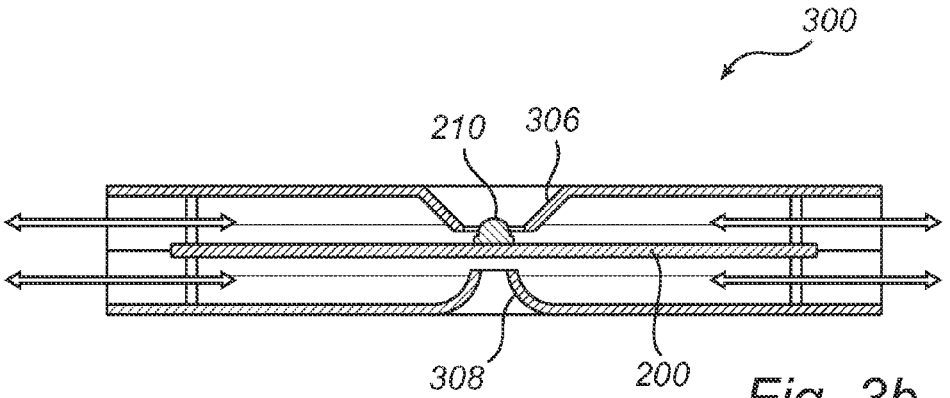

Preferably, the opening 306 may be arranged in close vicinity of the LED 210, such as is illustrated in FIG. 3*b*, and may also be covered by a reflective coating for allowing the opening to also act as a reflector for the LED 210. FIG. 3*b* also further illustrates the use of an opening 308 at the opposite side of the luminaire 300. Additionally, FIG. 3*b* shows, by means of arrows, the alternating directions of air flowing through the luminaire 300. Similarly to the cooling arrangement 100 of FIG. 1, the end portions of the enclosing portions 302 and 304 are open for allowing a free airflow, thereby forming air intakes/outtakes. However, different structures may be provided, including for example a filter member arranged within the air inlets/outlets.

Figure 4A:
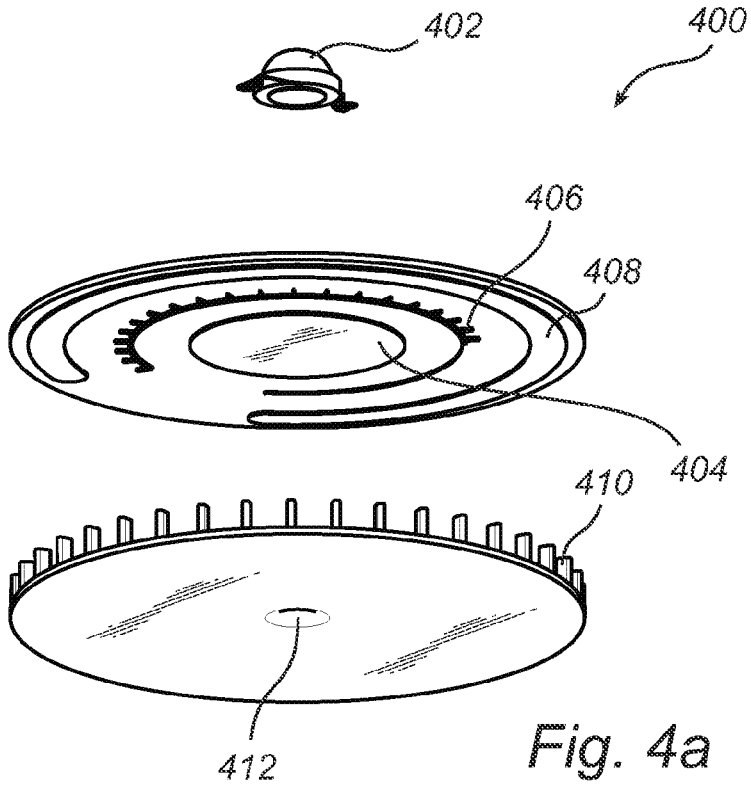
FIG. 4 is a schematic illustration of a different luminaire comprising an exemplary cooling arrangement according to the invention.
Figure 4B:
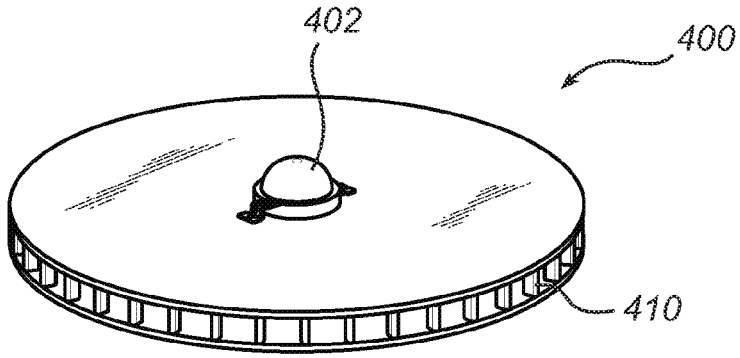
Figure 4C:
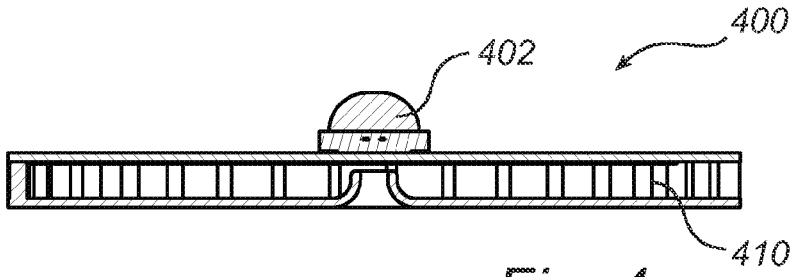

Finally, in FIG. 4*a*-4*c* it is respectively shown a cross section, a perspective top view and a side view of another embodiment of a luminaire 400 comprising a cooling arrangement according to a different embodiment of the present invention. The luminaire 400 further comprises an LED 402, a heat spreading layer (e.g. of copper) 404 arranged adjacent to the LED 402, a corona electrode 406, and a target electrode 408, together forming a "top section" of the luminaire 400. Additionally, the luminaire 400 comprises a plurality of spacing elements 410 arranged on a "bottom section" and a centrally positioned nozzle 412 (e.g. an air inlet/outlet opening). The top and the bottom sections may be connected together by means of for example glue, melting, snap fitting or any other suitable method.

The functionality of the luminaire 400 is similar to the embodiment described in relation to FIGS. 2 and 3. A difference is however that the luminaire 400 does not utilize the Venturi effect, but directly causes a jet-impingement cooling effect by creating a pressure drop at the inside center of the volume, formed by the plurality of spacing elements 410 on the bottom section and the top section by means of a corona wind. In this case, cool air is sucked in through the nozzle 412, warmed up by the heat-spreading surface on the PCB and blow out in a radial manner, outward from a center.

To summarize, it is according to the present invention possible to provide a cooling arrangement comprising a source electrode, a first and a second target electrode arranged at a distance from the source electrode, a hollow structure having a shell and control circuitry for controlling a voltage being applied between the source electrode and at least one of the first and the second target electrodes. The voltage is controlled such that an airflow resulting from a potential difference between the source electrode and at least one of the first and the second target electrodes is arranged to have alternating directions. By means of the invention it may be possible to provide cooling of a device having similar or better performances than a conventional heat sink and fan system, but with a smaller size and weight as well as being silent.

Even though the invention has been described with reference to specific exemplifying embodiments thereof, many different alterations, modifications and the like will become apparent for those skilled in the art. For example, the ion driven cooling may be applied in large LED array systems such as backlights, retrofit LED lamps, LED down lighters, etc. Also, the cooling arrangements above have generally been described with the application of a potential difference between the corona and a target electrode. The application of a potential difference may of course be provided by means of either one of an AC and a DC voltage. Additionally, variations to the disclosed embodiments can be understood and effected by the skilled addressee in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A cooling arrangement, comprising:

a source electrode for generating air ions;

a first and a second target electrode arranged at a distance from the source electrode; and control circuitry for controlling a voltage being applied between the source electrode and at least one of the first and the second target electrodes, wherein the application of the voltage is controlled such that an airflow resulting from a potential difference between the source electrode and at least one of the first and the second target electrodes is arranged to have alternating direction by alternately applying the voltage between the source electrode and the first target electrode and between the source electrode and the second target electrode, respectively.

2. The cooling arrangement of claim 1, further comprising a hollow structure having a shell, wherein the source electrode and the first and the second target electrodes are arranged inside of the hollow structure.

3. The cooling arrangement of claim 1, wherein the source electrode is a corona electrode.

4. The cooling arrangement of claim 1, wherein a distance between the source electrode and at least one of the first and the second target electrodes is larger than the distance at which electrical breakdown occurs at said voltage.

5. The cooling arrangement of claim 1, wherein the potential difference between the source electrode and at least one of the first and the second target electrodes is sufficient for ionization of molecules in the surrounding air at the corona electrode and subsequent air flow from said electrode towards the target.

6. The cooling arrangement of claim 1, wherein the source electrode and at least one of the first and the second target electrodes are arranged onto a substrate.

7. The cooling arrangement of claim 6, wherein the hollow structure comprises a first and a second portion, and the substrate is fixed between the first and the second portions.

8. The cooling arrangement of claim 1, wherein the source electrode and the first and the second target electrodes are coated with a noble metal.

9. The cooling arrangement of claim 2, wherein the hollow structure comprises an inflow portion and an outflow portion.

10. The cooling arrangement of claim 2, wherein the hollow structure comprises at least one opening having a cone shape towards the inside of the hollow structure for providing a Venturi effect.

11. A luminaire, comprising:

a light source; and a cooling arrangement, comprising a source electrode for generating air ions, a first and a second target electrode arranged at a distance from the source electrode, and control circuitry for controlling a voltage being applied between the source electrode and at least one of the first and the second target electrodes, wherein the application of the voltage is controlled such that an airflow resulting from a potential difference between the source electrode and at least one of the first and the second target electrodes is arranged to have alternating direction by alternately applying the voltage between the source electrode and the first target electrode and between the source electrode and the second target electrode, respectively.

12. The luminaire of claim 11, wherein the light source comprises at least one light emitting diode (LED).

13. The luminaire of claim 11, wherein the hollow structure comprises at least one opening having a cone shape towards the inside of the hollow structure, and the inside of the cone facing out of the hollow structure comprises a reflective member.

14. A method for cooling a luminaire, the method comprising:

providing a carrying member;

arranging a source electrode for generating air ions on the carrying member;

arranging a first and a second target electrode on the carrying member, wherein the first and the second target electrodes are arranged at a distance from the source electrode; and controlling a voltage being applied between the source electrode and at least one of the first and the second target electrodes, wherein the voltage is controlled such that an airflow resulting from a potential difference between the source electrode and at least one of the first and the second target electrodes is arranged to have alternating direction by alternately applying the voltage between the source electrode and the first target electrode and between the source electrode and the second target electrode, respectively.

15. The method of claim 14, wherein the source electrode is a corona electrode.

* * * * *